US005174787A

United States Patent [19]

Shirai et al.

[11] Patent Number: 5,174,787

[45] Date of Patent: Dec. 29, 1992

[54] ELECTRICAL CONNECTOR WITH CHECK TERMINAL

[75] Inventors: Akira Shirai; Mitsuyoshi Yamamoto; Haruo Kurosawa, all of Tokyo, Japan

[73] Assignee: Hirose Electric Co., Ltd., Tokyo, Japan

[21] Appl. No.: 755,877

[22] Filed: Sep. 6, 1991

[30] Foreign Application Priority Data

Sep. 14, 1990 [JP] Japan ..... 2-096050[U]

[51] Int. Cl.[5] ..... H01R 3/00

[52] U.S. Cl. ..... 439/489; 439/679

[58] Field of Search ..... 439/106, 347, 488, 489, 439/679

[56] References Cited

U.S. PATENT DOCUMENTS 4,034,172 7/1977 Glover et al. ..... 439/347
4,871,323 10/1989 Ohsumi ..... 439/347
4,915,648 4/1990 Takase et al. ..... 439/353
5,035,644 7/1991 Nakazato et al. ..... 439/488
5,062,806 11/1991 Ohno et al. ..... 439/488

*Primary Examiner*—Larry I. Schwartz
*Assistant Examiner*—Hien D. Vu
*Attorney, Agent, or Firm*—Kanesaka & Takeuchi

[57] ABSTRACT

An electrical connector (5) consists of a socket (10) and a plug (11). The socket includes a socket case (13) having a fitting cavity (14); at least one main signal terminal (15, 16) provided in the socket case such that contact sections (15*a*, 16*a*) thereof project into the fitting cavity; a check signal terminal (17) provided in the plug case such that a contact section thereof (17*a*) projects into the fitting cavity. The plug includes a plug case (23); at least one contact terminal (24, 25, 26) provided in the plug case for contact with the contact section of the main signal terminal and the check signal terminal; the contact section of the check signal terminal and the contact terminal being made such that they are brought into contact with each other only when the contact section of the main signal terminal is brought into complete contact with the contact terminal.

1 Claim, 8 Drawing Sheets

ELECTRICAL CONNECTOR WITH CHECK TERMINAL

BACKGROUND OF THE INVENTION

1. Field of the Invention

The present invention relates electrical connectors for connecting the output of a controller to the control unit of an air bag in an air bag system.

2. Description of the Prior Art

FIG. 1 shows an air bag system mounted in a car. The air bag system includes a driver side air bag 2 mounted on a steering wheel 1, a passenger side air bag 3, a controller 4, and an electrical connector 5 for connecting the output of the controller 4 to control units of the driver side air bag 2 and the passenger side air bag 3. Upon collision, a sensor senses the impact and sets the controller 4 in operation. The controller generates signals for controlling the control units of the driver side air bag 2 and the passenger side air bag 3 to expand instantly these air bags, thereby protecting the driver and the passenger against the impact.

When a car having an air bag system is delivered, it is necessary to connect the driver side air bag 2 and the passenger side air bag 3 to the controller 4 without failure. However, even if the plug is not completely inserted into the socket in the above electrical connector, the main signal can be transmitted by the connector so that the car is delivered. During uses, however, the plug can be come off from the socket with vibrations so that the air bag system fails to operate in the event of an accident.

SUMMARY OF THE INVENTION

Accordingly, it is an object of the invention to provide an electrical connector capable of indicating whether the connection between the plug and the socket is complete, thereby helping prevention of the delivery of a loosely connected electrical system such as an air bag system in a car.

According to the invention there is provided an electrical connector consists of a socket and a plug. The socket includes a socket case having a fitting cavity; at least one main signal terminal provided in the socket case such that contact sections thereof project into the fitting cavity; a check signal terminal provided in the socket case such that a contact section thereof projects into the fitting cavity. The plug includes a plug case; at least one contact terminal provided in the plug case for contact with the contact section of the main signal terminal;,a contact terminal provided in the plug case for contact with the check signal terminal; the contact section of the check signal terminal and the contact terminal being made such that they are brought into contact with each other only when the contact section of the main signal terminal is brought into complete contact with the contact terminal.

It is preferred that the contact section of the check signal terminal is shorter than the contact section of the main signal terminal.

Only when the main signal terminals are connected to the contact terminal of the plug, the check signal terminal is brought into contact with the contact terminal to transmit the check signal, indicating that the connection between the plug and socket is complete.

When the connection between the plug and the socket is incomplete, the check signal terminal is not in contact with the contact terminal so that no check signal is transmitted, indicating the incomplete connection between the plug and the socket. In other words, unless the connection between the plug and the socket is complete, the check signal terminal is not brought into contact with the contact terminal, breaking the check signal circuit and indicating the incomplete connection.

The above and other objects, features, and advantages of the invention will be more apparent from the following description when taken in conjunction with the accompanying drawings.

DESCRIPTION OF THE PREFERRED EMBODIMENT

Figure 2:
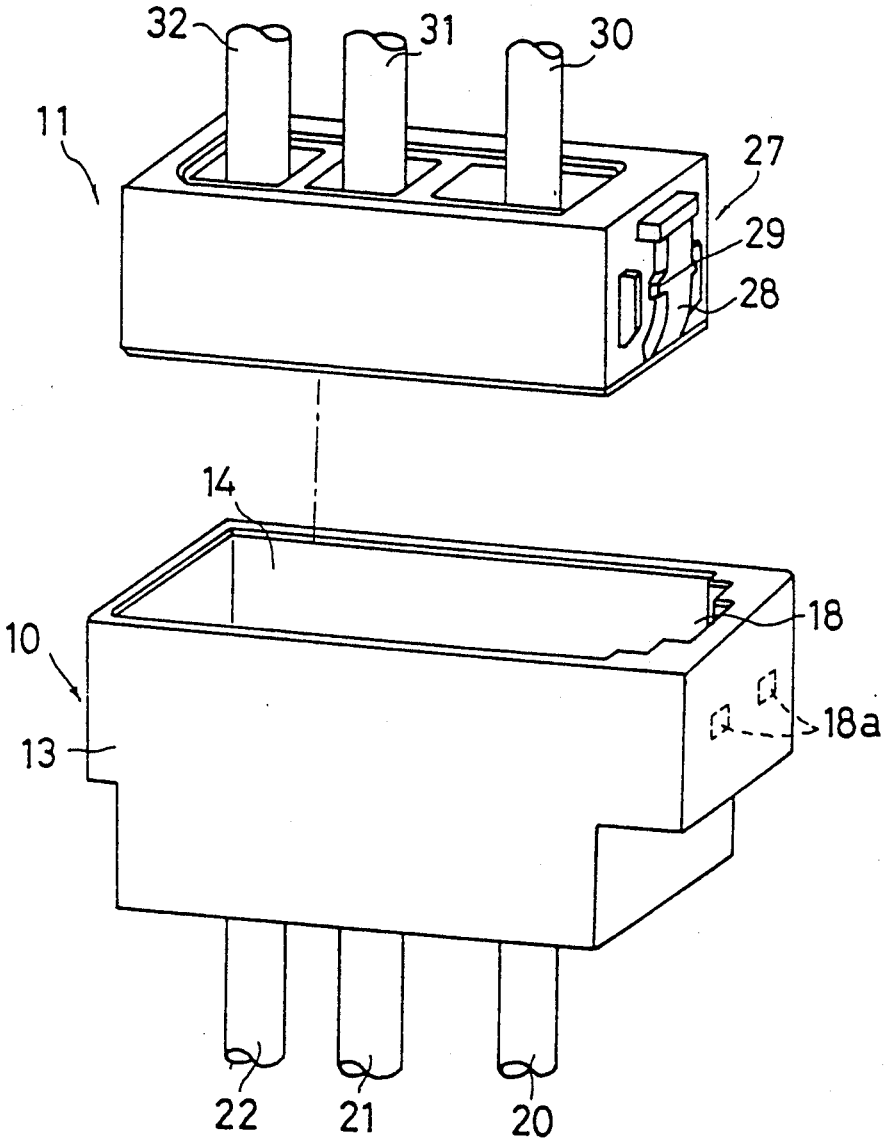
FIG. 2 is a perspective view of an electrical connector consisting of a socket and a plug according to an embodiment of the invention.

In FIG. 2, the electrical connector consists of a plug 11 and a socket 10. The plug 11 is inserted into the socket 10 to transmit a main signal. The socket 10 includes an insulator case 13 having a fitting cavity 14.

Figure 1:
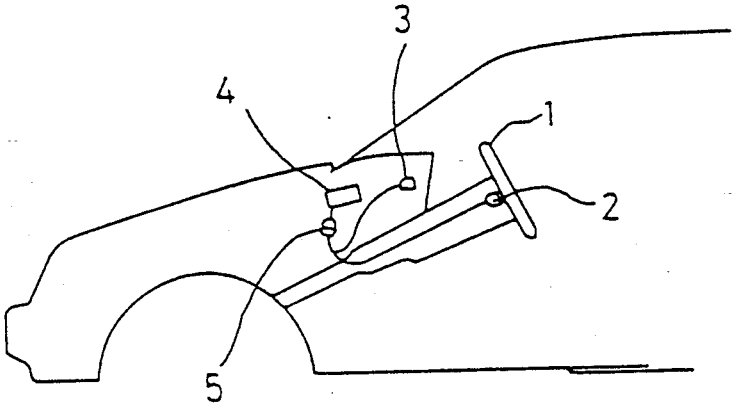
FIG. 1 is a schematic diagram of an air bag system mounted in a car.
Figure 3:
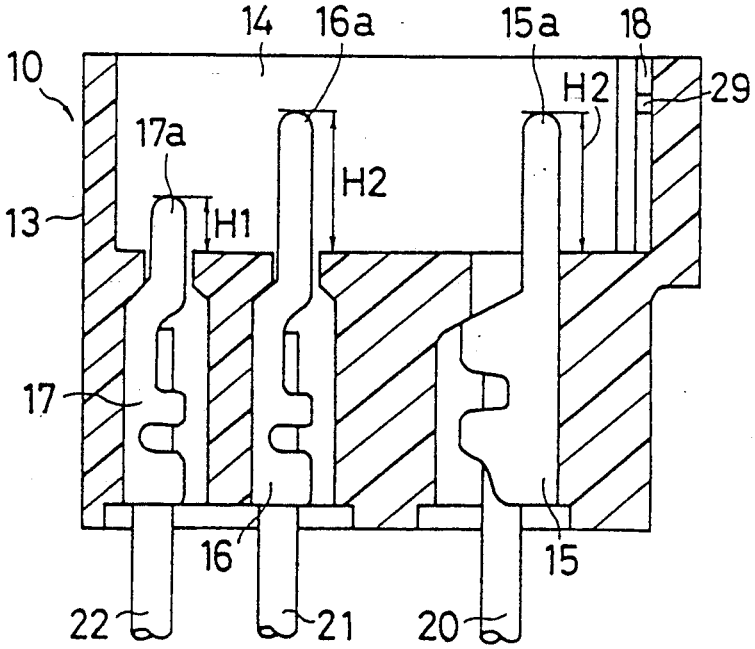
FIG. 3 is a longitudinal section of the socket.

In FIG. 3, two main signal terminals 15 and 16 and a check signal terminal 17 are mounted in the socket case 13 such that their contact sections 15*a*, 16*a*, and 17*a* project into the fitting cavity 14. The height H1 of the check signal terminal 17 is made less than the height H2 of the main signal terminals 15 and 16. A lock mechanism insertion recess 18 is formed on the right side of the fitting cavity 14. As best shown in FIG. 2, a lock portion 18*a* is formed on the insertion recess 18. The main signal terminals 15 and 16 are connected to signal lines 20 and 21 from the controller 4, and the check signal terminal 17 is connected to a check signal line 22.

Figure 4:
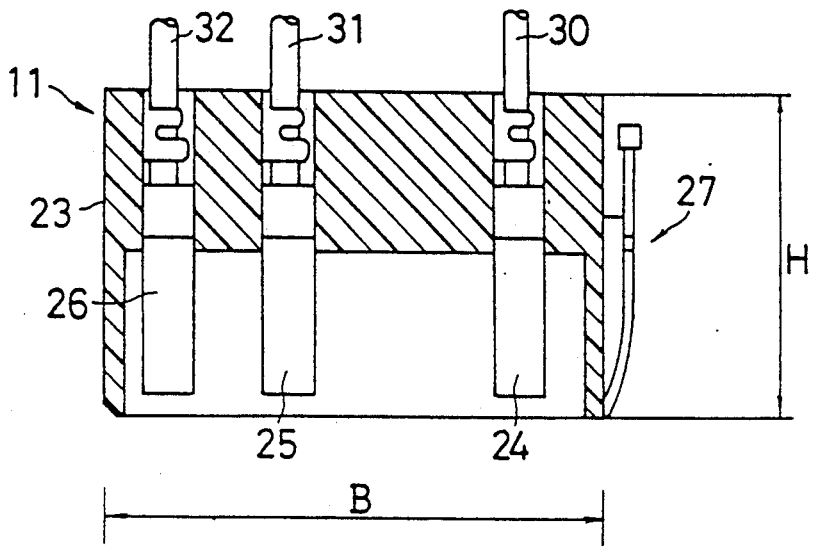
FIG. 4 is a longitudinal section of the plug.
Figure 5:
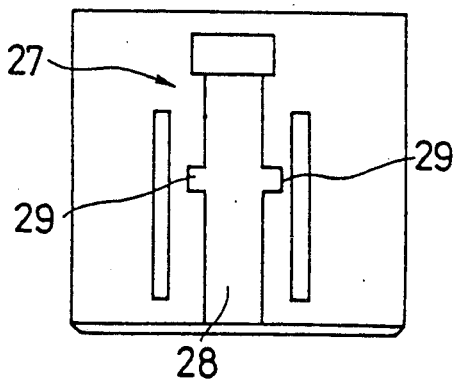
FIG. 5 is a side elevational view of the plug.

In FIGS. 4 and 5, the plug includes a plug case 23; three identical contact terminals 24, 25, and 26 mounted in the plug case 23; and a lock mechanism 27 formed on the right side of the plug case 23. As the plug 11 is inserted in the socket 10, the contact terminals 24, 25, and 26 are brought into contact with the contact sections 15*a* and 16*a* of the main signal terminals 15 and 16 and then the contact section 17*a* of the check signal terminal 17. A cantilevered lock arm 28 of the lock mechanism 27 is fitted into the insertion recess 18 so that the lock projections 29 engage lock shoulders 18*a* of the insertion recess 18 to thereby lock the plug 11 to the socket 10

Figure 7:
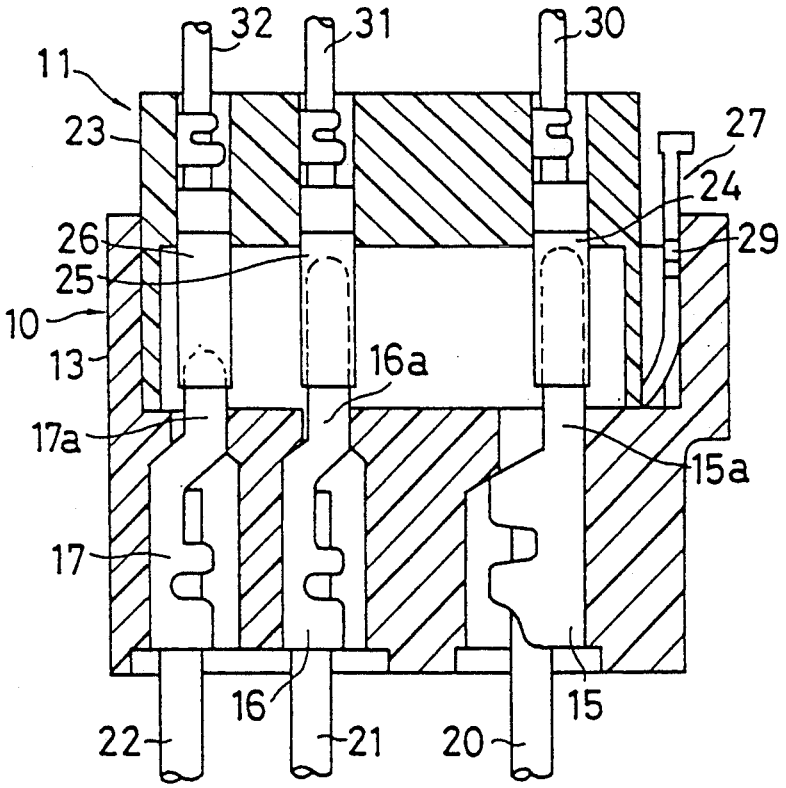
FIG. 7 is a sectional view showing a complete connection between the plug and the socket.
Figure 8:
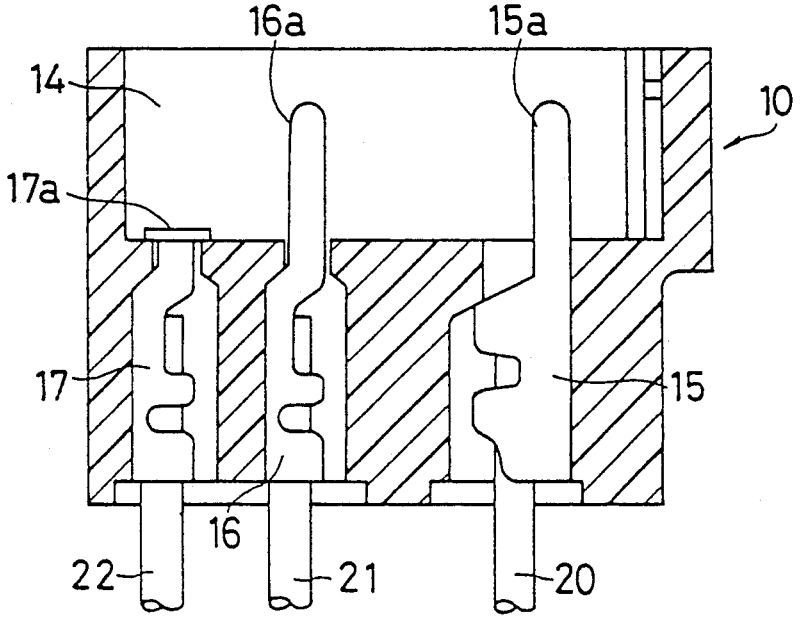
FIG. 8 is a longitudinal section of the socket of an electrical connector according to another embodiment of the invention.
Figure 9:
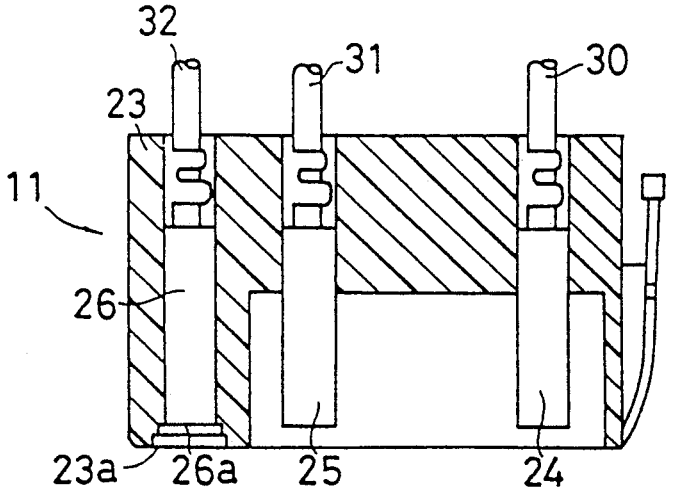
FIG. 9 is a longitudinal section of the plug of the electrical connector.

In FIG. 7, when the plug 11 is fitted into the socket 10 completely, the contact section 17*a* of the check signal terminal 17 is connected to the contact terminal 26 on the check signal side as well as the contact sections 15*a* and 16*a* of the main signal terminals 15 and 16 are connected to the contact terminals 24 and 25. Consequently, the check signal is transmitted, indicating that the plug 11 has been connected to the socket 10 completely.

Figure 6:
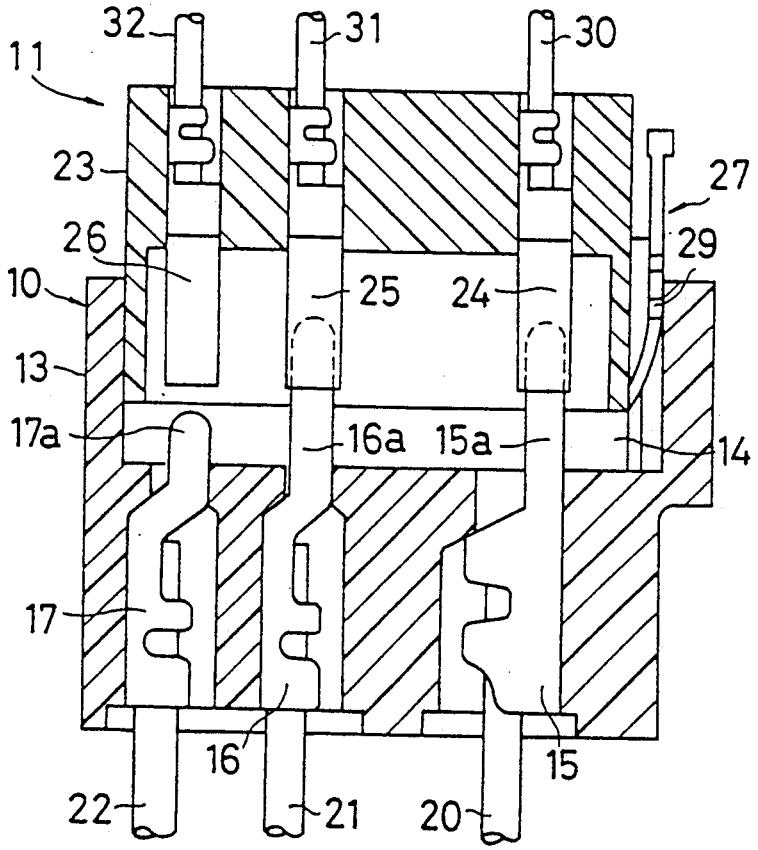
FIG. 6 is a sectional view showing an incomplete connection of the plug and the socket.

In FIG. 6, when the connection between the plug 11 and the socket 10 is incomplete, the contact section 17*a* of the check signal terminal 17 is not brought into contact with the contact terminal 26 on the check signal side while the contact sections 15*a* and 16*a* of the main signal terminals 15 and 16 are brought into contact with the contact terminals 24 and 25 of the plug 11. Consequently, no check signal is transmitted, indicating that the connection between the plug 11 and the socket 10 is incomplete.

In FIGS. 8–11, the check signal terminal 17 of the socket 10 has a disc-like contact section 17*a*. The contact terminal 26 on the check signal side of the plug 11 has a flat front end 26*a* which is mounted in a recess 23*a* of the plug case 23.

As the plug 11 is inserted into the fitting cavity 14 of the socket 10 such that the contact sections 15*a* and 16*a* of the main signal terminals 15 and 16 are brought into contact with the contact terminals 24 and 25, and then the flat contact section 17*a* of the check signal terminal 17 is brought into contact with the flat contact portion 26*a* of the contact terminal 26 of the plug 11.

Figure 11:
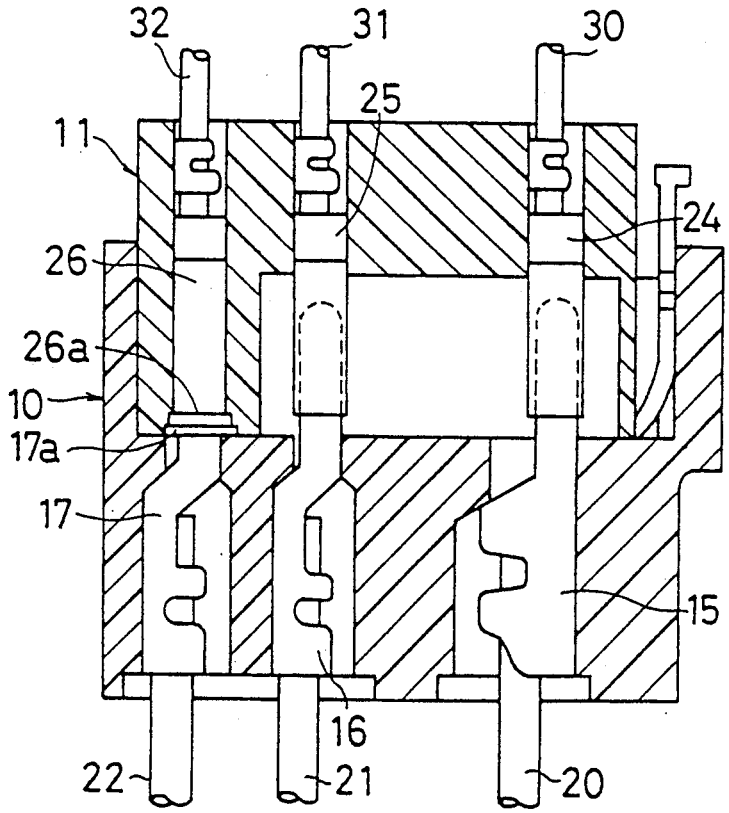
FIG. 11 is a sectional view showing a complete connection between the plug and the socket.

In FIG. 11, when the plug 11 is fitted into the socket 10 completely, the flat contact portion 17*a* of the check signal terminal 17 is brought into contact with the flat contact portion 26*a* of the contact terminal 26 as well as the contact of the main signal terminals 15 and 16 with the check signal contact terminals 24 and 25. Consequently, the check signal is transmitted, indicating the complete connection between the plug 11 and the socket 10.

Figure 10:
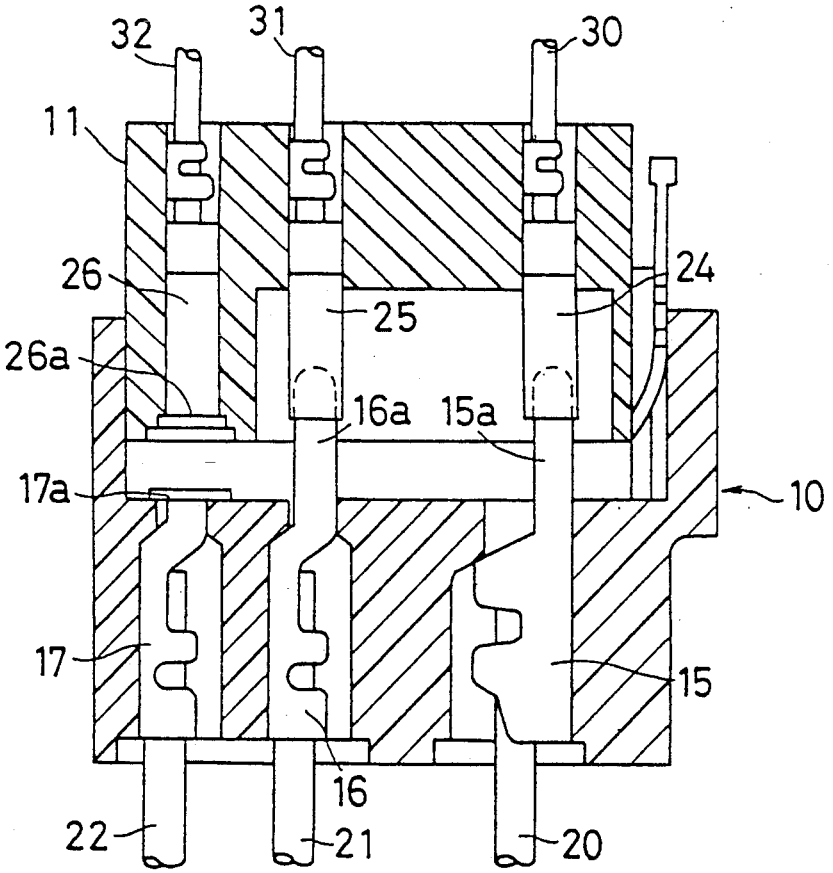
FIG. 10 is a sectional view showing an incomplete connection of the plug and the socket.

In FIG. 10, when the connection between the plug 11 and the socket 10 is incomplete, the flat contact portion 17*a* of the check signal terminal 17 is not brought into contact with the flat contact portion 26*a* of the contact terminal 26 while the contact sections 15*a* and 16*a* of the main signal terminals 15 and 16 are brought into contact with the contact terminals 24 and 25 of the plug 11. Consequently, the check signal is not transmitted, indicating the incomplete connection between the plug 11 and the socket 10.

As has been described above, according to the invention, only when the connection between the contact sections of the main signal terminals and the contact terminals is completed, the contact sections of the check signal terminal is brought into contact with the contact terminal so that the check signal is transmitted, indicating the complete connection between the plug and the socket. When the connection between the plug and the socket is incomplete, on the other hand, the contact section of the check signal terminal is not in contact with the contact terminal of the plug so that no check signal is transmitted, indicating the incomplete connection between the plug and the socket. Thus, a loose fitting between the plug and the socket is found before delivery.

We claim:

1. An electrical connector consisting of a socket and a plug, said socket comprising:

a socket case having a fitting cavity;

at least one main signal terminal provided in said socket case such that contact sections thereof project into said fitting cavity;

a check signal terminal provided in said socket case such that a contact section thereof projects into said fitting cavity, said plug comprising:

a plug case;

at least one signal contact terminal provided in said plug case for contact with said contact section of aid main signal terminal;

a check contact terminal provided in said plug case for contact with said check signal terminal;

said contact section of said check signal terminal having a flat front end which is substantially flush with a bottom surface of said fitting cavity and said check contact terminal having a flat front end which is substantially flush with a front face of said plug case so that said check signal terminal and said check contact terminal are brought into contact with each other only when said contact section of said main signal terminal is brought into complete contact with said contact terminal.

* * * * *